US011053070B2

(12) United States Patent
Butler et al.

(10) Patent No.: US 11,053,070 B2
(45) **Date of Patent: *Jul. 6, 2021**

(54) WASTE RECEPTACLE WITH INNER BAG

(71) Applicants: Pamela A. Butler, Hollywood, FL (US); Michael W. Carter, Hollywood, FL (US)

(72) Inventors: Pamela A. Butler, Hollywood, FL (US); Michael W. Carter, Hollywood, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/697,130

(22) Filed: Apr. 27, 2015

(65) Prior Publication Data

US 2016/0052710 A1 Feb. 25, 2016

Related U.S. Application Data

(60) Provisional application No. 62/041,434, filed on Aug. 25, 2014.

(51) Int. Cl.
*B65F 1/06* (2006.01)
*B65F 1/14* (2006.01)
(Continued)

(52) U.S. Cl.
CPC ..... *B65F 1/06* (2013.01); *B65F 1/141* (2013.01); *B65F 1/1415* (2013.01);
(Continued)

(58) Field of Classification Search
CPC .... B65F 1/06; B65F 1/1415; B65F 2220/106; B65F 2210/139; B65F 1/141;
(Continued)

(56) References Cited

U.S. PATENT DOCUMENTS 2,954,891 A * 10/1960 Imber ..... B65D 81/3834 383/20
5,409,282 A * 4/1995 Bale ..... A45C 3/00 294/146
(Continued)

FOREIGN PATENT DOCUMENTS

CN 102320442 A 1/2012
CN 203753722 U 8/2014
(Continued)

OTHER PUBLICATIONS

Trasharoo Tire Trash Bag; Jun. 24, 2012.
Promark Off Road Trail Bag; Feb. 24, 2011.
Pop-Up Camp Trash Can; 1996.

*Primary Examiner* — Robert Poon
(74) *Attorney, Agent, or Firm* — Gould & Ratner

(57) ABSTRACT

The present invention provides a waste receptacle comprising an outer bag having a flexible construction forming an opening at a top side and at least a pair of upper straps capable of attaching the receptacle to a rail, a lid attached at a top of bag to close the opening. The receptacle having an inner bag having a backbone circumferentially disposed around the inner bag to help maintain the inner bag in a generally cylindrical shape, the inner bag insertable through the opening of the outer bag and a pull string to disposed at the top of the inner bag being capable to cinch the top of the inner bag closed and a bouyant float member disposed in the outer bag.

18 Claims, 7 Drawing Sheets

(51) Int. Cl.
*B65F 1/16* (2006.01)
*B65F 1/00* (2006.01)
*B63B 17/00* (2006.01)

(52) U.S. Cl.
CPC ..... *B65F 1/1607* (2013.01); *B65F 1/1615* (2013.01); *B63B 17/00* (2013.01); *B65F 1/002* (2013.01); *B65F 1/0013* (2013.01); *B65F 1/1468* (2013.01); *B65F 2220/112* (2013.01); *B65F 2250/00* (2013.09)

(58) Field of Classification Search
CPC ..... B65F 1/1607; B65F 1/0013; B65F 1/002; B65F 1/1468; B65F 2220/112; A45C 13/1038; A45C 7/0077; A45C 11/22; A45C 13/008; A45C 13/30; A45C 13/40; B65D 81/3834; B65D 81/3886
USPC ..... 220/495.06, 560, 229; 206/233; 383/61.4, 51, 49, 104, 121.1
See application file for complete search history.

(56) References Cited

U.S. PATENT DOCUMENTS 5,518,315 A * 5/1996 Nichols ..... A45C 3/00 383/119
5,803,778 A 9/1998 Hardy
5,904,230 A * 5/1999 Peterson ..... A45C 11/20 190/107
5,947,584 A * 9/1999 Passanante ..... B65F 1/1426 362/154
6,073,372 A * 6/2000 Davis ..... B65D 33/004 383/121.1
6,074,259 A 6/2000 Lastrajoli et al.
6,343,729 B1 2/2002 Platta
6,409,076 B1 * 6/2002 Wang ..... A45C 7/0036 229/122.34
6,471,054 B2 10/2002 Nevarez
6,614,004 B2 * 9/2003 Moriya ..... B41J 11/002 219/216
6,629,430 B2 * 10/2003 Mills ..... B65D 81/3888 62/457.2
7,320,411 B1 * 1/2008 Shenosky ..... A45C 3/04 220/495.06
7,815,069 B1 * 10/2010 Bellofatto ..... B65D 81/3886 220/666
7,815,372 B2 10/2010 Stanton et al.
8,365,912 B2 2/2013 Carroscia et al.
8,887,935 B2 11/2014 Zemitis et al.
10,518,971 B2 * 12/2019 Butler ..... B65F 1/002
2003/0016886 A1 * 1/2003 Smith ..... B65G 51/06 383/75
2003/0103691 A1 * 6/2003 Adams ..... A45C 7/0077 383/38
2005/0279014 A1 * 12/2005 Beech ..... A01K 97/05 43/55
2006/0078987 A1 * 4/2006 Krier ..... B65F 1/1415 435/290.1
2006/0131308 A1 * 6/2006 Drake ..... B65F 1/1607 220/229
2007/0183691 A1 * 8/2007 Finnegan ..... B65D 85/18 383/23
2007/0261977 A1 * 11/2007 Sakai ..... A01K 97/06 206/315.11
2008/0056625 A1 3/2008 Stanton et al.
2008/0073353 A1 * 3/2008 Lapoint ..... B65D 77/061 220/495.06
2008/0128422 A1 * 6/2008 Adler ..... B60R 7/043 220/495.06
2009/0250470 A1 * 10/2009 Merrick ..... B25H 3/00 220/495.06
2012/0189230 A1 * 7/2012 King ..... B65F 1/1415 383/33
2012/0255983 A1 * 10/2012 Semone ..... A45F 3/04 224/585
2013/0086774 A1 * 4/2013 Krasinski ..... A45C 13/001 24/16 R
2014/0110412 A1 * 4/2014 Johnson ..... A47G 23/0216 220/560

FOREIGN PATENT DOCUMENTS

FR 2790459 A1 9/2000
GB 2470765 A 12/2010
WO 2005089590 A1 9/2005

* cited by examiner

WASTE RECEPTACLE WITH INNER BAG

This application claims priority to U.S. Provisional Application No. 62/041,434 filed on Aug. 25, 2014.

SUMMARY

The present invention relates to waste receptacles and in particular a waste receptacle having an inner bag.

BACKGROUND

A robust and spill proof waste receptacle is desired in many circumstances. However, many waste receptacles may provide a partial solution. Some receptacles may provide for a safe and secure place to dispose of waste, such as trash and other garbage, but may not be easily accessible or usable by people needing to later move the waste receptacle to a larger garbage bin. For example, in the marine context, it is very detrimental to the environment when waste is spilled from a boat into the water. Even in circumstances where the boaters attempt to place their waste into a receptacle on boat; in rough seas those receptacles can easily go overboard and the waste then escapes the receptacle and enters into the water where it can disrupt the environment. Further, the receptacles that may be used on board a boat do not allow for easy removal of the receptacle when the boat is docked. When the waste must be removed from the boat, taken to land and placed in a land based garbage bin there are complications with currently available receptacles. The present invention overcomes many of these disadvantages.

SUMMARY

The present invention is a waste receptacle comprising an outer bag having a flexible construction forming an opening at a top side and at least a pair of upper straps capable of attaching the receptacle to a rail, a lid attached at a top of bag to close the opening, an inner bag having a backbone circumferentially disposed around the inner bag to help maintain the inner bag in a generally cylindrical shape, the inner bag insertable through the opening of the outer bag, a pull string disposed at the top of the inner bag being capable to cinch the top of the inner bag closed and a buoyant float member disposed in the outer bag.

The straps may have a fastener to clamp sides of the strap together on the rail. The fastener may be a velcro type member on each side of the strap. The backbone may be a plastic or metal wire that is sewn to the inner bag. The float member may be sewn into a bottom panel of the outer bag. The lid may include a slit having flexible sides including a resilient cord disposed along each side of the slit, the slit capable of being stretched apart by at least 1 inch in order to allow for insertion of waste into the interior of the outer bag and to be received by the inner bag, the flexible sides movable between an open and closed position and the sides automatically retractable to the closed position.

An elastic band may be disposed across the top of the outer bag in order to maintain the bag in a collapsed condition. A pair of lower straps may be located along a base of the outer bag. The pair of straps may include fasteners for holding the sides of the straps together and to clamp onto a post. The pair of straps may form a generally cylindrical area capable of receiving a rail or other mounting member therein and the cylindrical area having an axis disposed in a generally vertical orientation with respect to the receptacle. The pair of upper straps may form a generally cylindrical area capable of receiving a rail or other mounting member therein and the cylindrical area having an axis disposed in a generally horizontal orientation with respect to the receptacle. A band may be disposed at the bottom of the outer bag and for maintaining the bouyant member within the outer bag. A rigid plate may be disposed on a back panel of the outer bag.

A zipper disposed along a top edge of the opening of the outer bag may fasten the lid in a closed condition. At least a pair of zipper pulls may be provided for opening and closing the zipper. A locating device may be disposed within the receptacle including one of a transmitter, light emitting device and reflector so that the receptacle may be more easily located if the receptacle is floating in water.

In an embodiment, an outer bag is provided having a lid attached at a top of the outer bag to close an opening at the top of the bag, the outer bag formed from a flexible material capable of orienting the outer bag between a collapsed and upright condition. An inner bag formed of a flexible nylon material is provided and the inner bag is insertable through the opening of the outer bag; and a buoyant float member is disposed in the outer bag. The lid may be hingedly attached to the outer bag, the lid including a slit having flexible sides including a resilient cord disposed along each side of the slit, the slit capable of being stretched apart by at least 1 inch in order to allow for insertion of waste into the interior of the outer bag and to be received by the inner bag, the flexible sides movable between an open and closed position and the sides automatically retractable to the closed position.

In an embodiment, the invention provides a method of managing waste material to avoid polluting water systems comprising the steps of providing an outer bag having a lid attached at a top of the outer bag to close an opening at the top of the bag, a slit formed in the lid, a pair of straps disposed on the outer bag, an inner bag formed of a flexible nylon material, the inner bag inserted through the opening of the outer bag and a buoyant float member disposed in the outer bag, mounting the outer bag to a rail of a boat by fastening the pair of straps around the rail, zipping the lid in a closed condition so that in case of rough water affecting the orientation of the outer bag, the outer bag will maintain waste disposed inside the outer bag, disposing of waste material within the inner bag by inserting through an expandable slit formed in the lid, accessing the inner bag when full by unzipping the lid of the outer bag in order to flip the lid upward and expose the inner bag, cinching a pull string on the inner bag to close the top of the inner bag, pulling the inner bag through the opening of the outer bag, grabbing a handle of the inner bag and carrying the inner bag off the boat and emptying the waste material of the inner bag into a garbage bin on land. The method may further comprise the step of registering the boat as an environmentally compliant vessel, being equipped with a water friendly waste receptacle.

Figure 1:
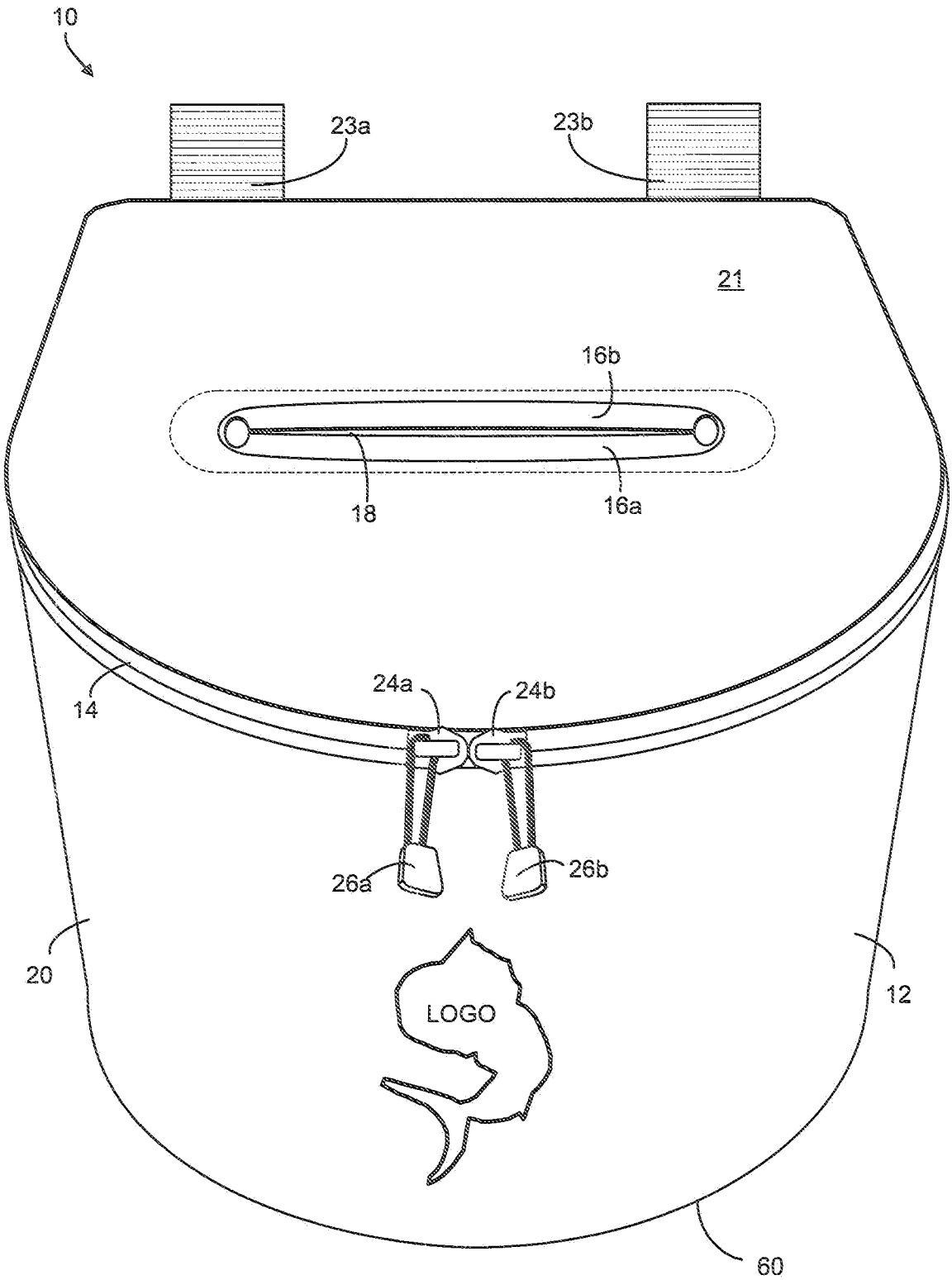
FIG. 1 is a perspective view of the waste receptacle of the present invention.

While the invention is amendable to various modifications and alternate forms, specific embodiments have been shown by way of example in the drawings and will be described in detail. It should be understood that the intention is not to limit the invention to the particular embodiments described. The intention is to cover all modifications, equivalents and alternatives falling within the spirit and the scope of the invention.

DETAILED DESCRIPTION

A marine soft-sided trash receptacle assembly 10 comprised of two primary components of an exterior bag assembly 20 and interior bag 40 as shown in FIGS. 1-7. The primary purpose of the bag is to gather harmful refuse that compiles during a fishing/boating/aquatic trip to reduce waste such as paper, plastics and aluminums trash that are commonly found floating in the ocean and lakes.

The exterior bag 20 is made of a water resistant sunbrella material or the like. The exterior bag has four nylon straps 23*a,b*, 34*a,b* which fasten closed around a rail or hook of a boat or vehicle such as by using a Velcro fastener. In an alternate embodiment, a plastic clip or fastener closes the sides of the strap. The over lapped lid 21 extends from the top edge 24 of the body 12 to securely shut, for example by closing a zipper while the boat is in motion. In an embodiment, the exterior bag 10 may be decorated with an embroidered marine figure. Four nylon straps 23*a,b*, 34*a,b* total are secured by fasteners such as Velcro. In an embodiment, the straps may be lined with slip-resistant material. A single strap or combination of one or all straps may be used to secure the bag 10 in its desired location on the vessel.

The base of the soft-sided exterior bag is equipped with a floating device 51 built into it made from a plastic foam material such as polyvinyl and polyethylene or the like. This floating device helps to ensure the securely enclosed trash will not end up at the bottom of the ocean. In emergency cases this floating feature may also assist in a man-overboard situation.

The interior component 40 to the soft-sided trash receptacle is what will actually contain the debris. This interior bag is designed to allow the exterior bag to stay in place on the vessel, during removal of the interior bag filled with debris. Tightening a drawstring ensures no spillage and the interior bag may be taken to proper disposal locations. The interior bag 40 is made of a tightly woven water resistant fabric such as nylon or polyester (similar to an umbrella) and sits with in the exterior bag. This oblong shaped bag will be self standing by way of polyamide plastic or coated metal fabricated coil 50 with the strength to hold the bag standing and will be sewn into the polyester fabric of the bag from the top rim to bottom rim to give the bag 40 the upright position needed to stand when empty.

The interior bag 40 will have the nylon material slack at the top 43 several inches without the sewn in coil interior and just a drawstring 41 that can securely lock closed 42 at the outer limit to function as a closing devise for the interior bag. Affixed externally to this interior bag will be a fabric handle 44 made of a nylon material or the like for easy carrying.

FIG. 1 depicts the receptacle 10 including the outer bag 20 that is formed by an outer wall having a semicircular shape on the front side and a flat surface on the back side 13. In an embodiment, the material for the outer bag 20 is water resistant and flexible. The top, including top rear edge 24 (FIG. 5) and top edge 14 of the opening (FIG. 2) of the outer bag 20 is enclosed by a lid 21. The lid 21 includes a slit 18 which is formed by a pair of flexible sides 16. Each side 16 may include a resilient cord running from each end of the slit 18. The resilient sides 16 are capable of being flexed outward to separate the slit 18 for the insertion of waste through the lid 21. In an embodiment, the sides 16 can flex at least one inch in order to insert waste therethrough. As depicted in FIG. 1 the slit is in the closed position. The slit 18 is also capable of being in an open position when a user inserts her hand into the slit 18 causing the sides 16*a,b* to separate and move to an open position. In an alternate embodiment the slit 18 may be provided by a Zipper, Velcro, a magnet trim, buckle, plastic, snaps, rubber or plain fabric.

The resilient nature of the sides 16*a,b* will cause the sides to automatically retract and close the slit 18. This feature of the lid allows for the securement of waste within the outer bag 20. In the case of rough seas, where the bag 20 is thrown about and not oriented in a level orientation, the waste will still be retained within the inside of the outer bag 20 due to the closed slit 18. As well, if the receptacle were to break free of its mounting position on a rail or stanchion of a boat and land in the water, it will continue to maintain the waste articles within the interior bag 40 due to the resilient nature of the slit 18 being maintained in a closed position. The lid 21 is secured to the body of the outer bag 20 using any known means of fastening. In an embodiment, as shown in FIG. 1, a zipper is used at the top edge 14 of the body of the outer bag 20. Zipper members 24*a,b* run along the edge of the opening 14. Zipper pulls 26*a,b* may be grasped by fingers to easily zip and unzip the lid. In the fully zipped position as shown in FIG. 1, with the zipper members 24*a,b* side by side, the lid 21 is securely fastened to the body of the outer bag 20. No waste can escape through the side edge 14 when zipped. In an alternate embodiment, the zipper function may be provided by Velcro, cloth flap overlap, buckles, snaps or a pull string.

Figure 2:
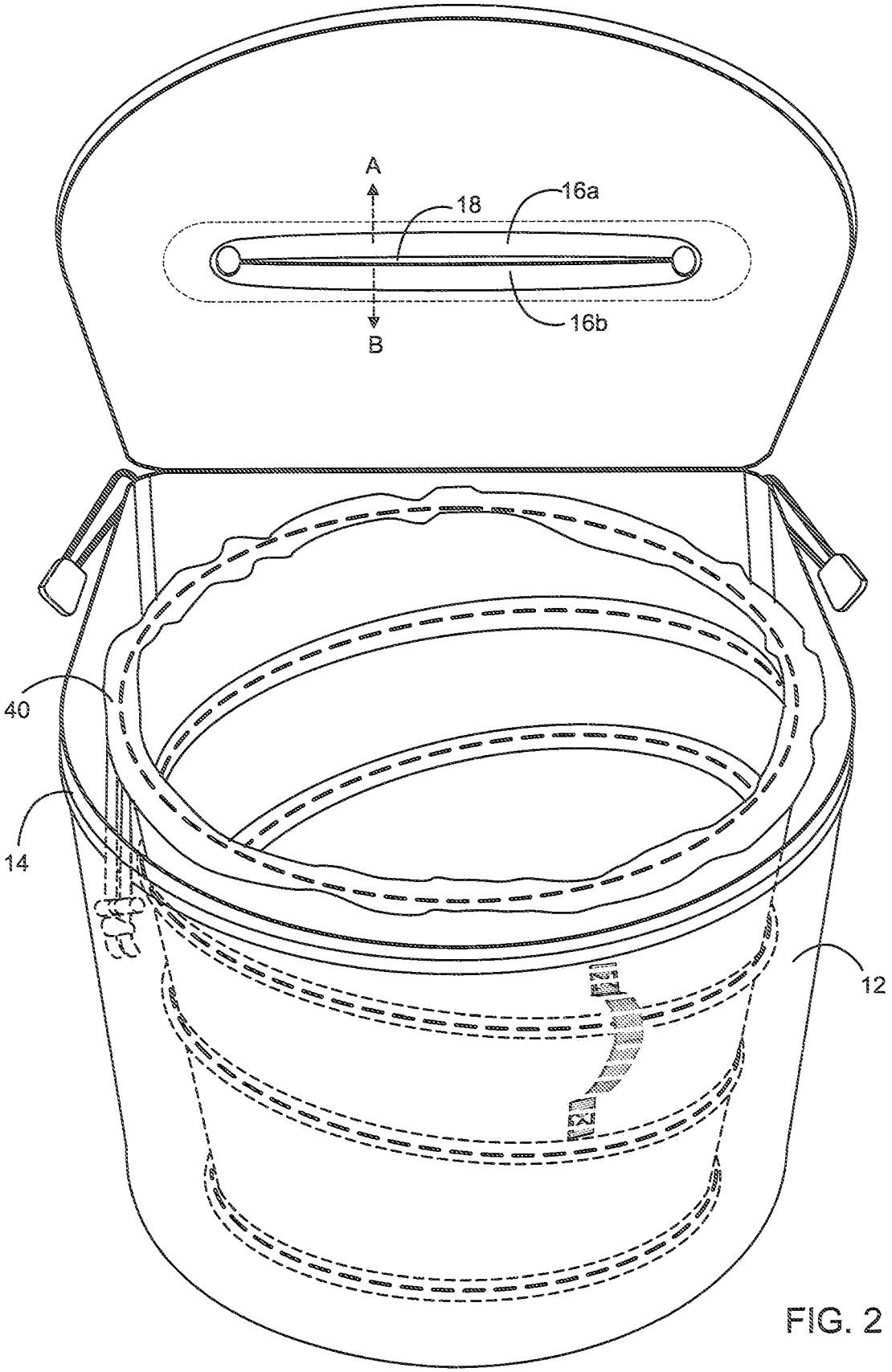
FIG. 2 is a perspective view of the waste receptacle of FIG. 1, having the lid in the open position to reveal the inner bag disposed within the outer bag.
Figure 5:
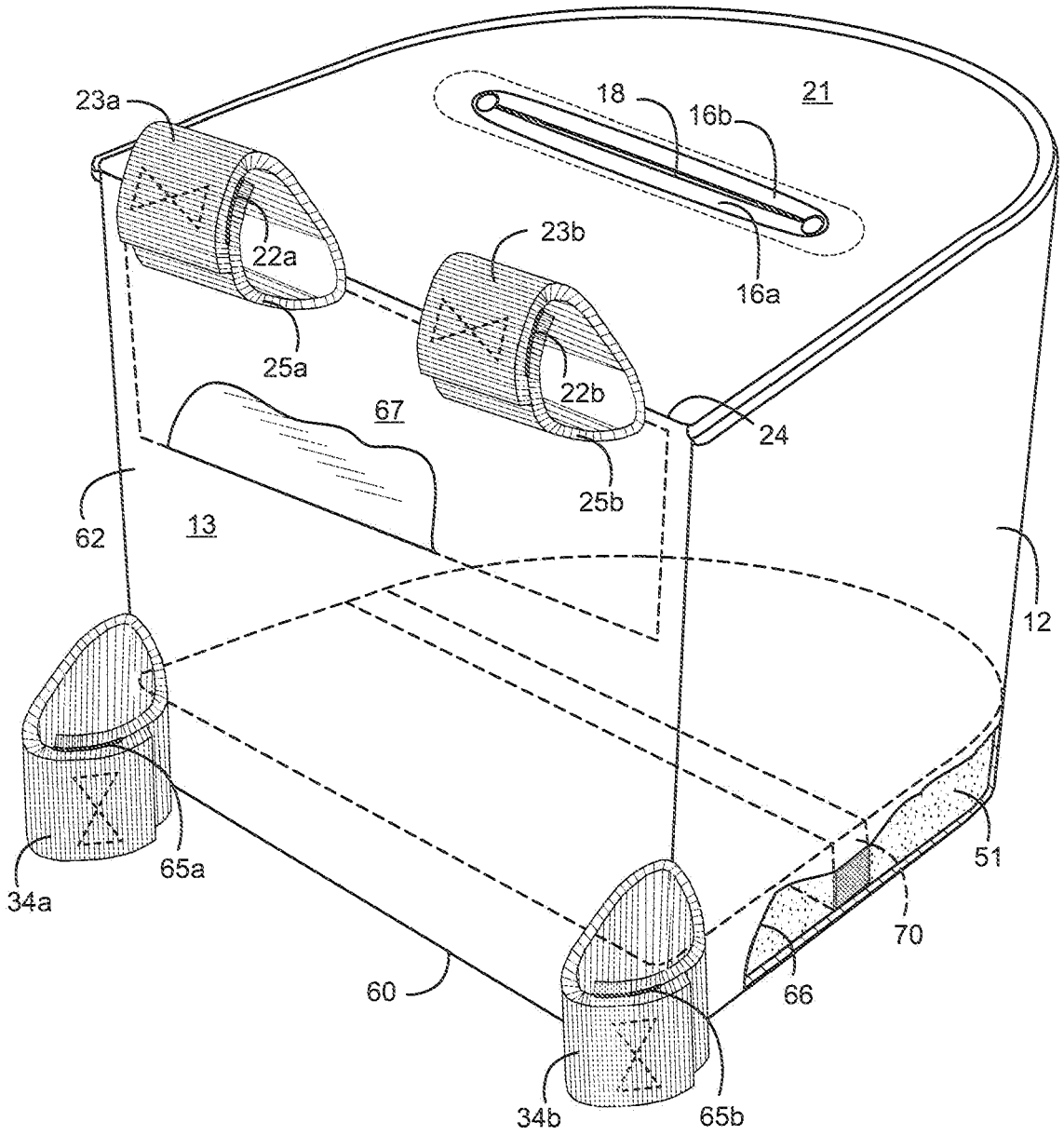
FIG. 5 is a perspective partially transparent view of the rear of the outer bag of FIG. 1.

Turning to FIG. 2, the outer bag 20 is shown with the lid 21 depicted in the open position. The lid 21 is hingedly attached at edge 24 (FIG. 5) to the body of the outer bag 20. The zippers have been moved around along the upper edge 14 of the opening and are in the open most position as shown by the zipper pulls 24*a,b*, towards the backside 13 of the outer bag. The lid 21 shows the underside of the slit 18 and the resilient sides 16*a,b* of the slit. The inner bag 40 is depicted in its assembled position within the interior of the outer bag 20. Straps 23*a,b*, 34*a,b* are depicted along the backside of the outer bag 20 (FIG. 5). In an alternate embodiment, the function of the straps may be provided by a nut and bolt mounting bracket, C-clamps, rope/ties, buckles, snaps, zip ties, 1-brackets, cargo straps or rivets.

Figure 3:
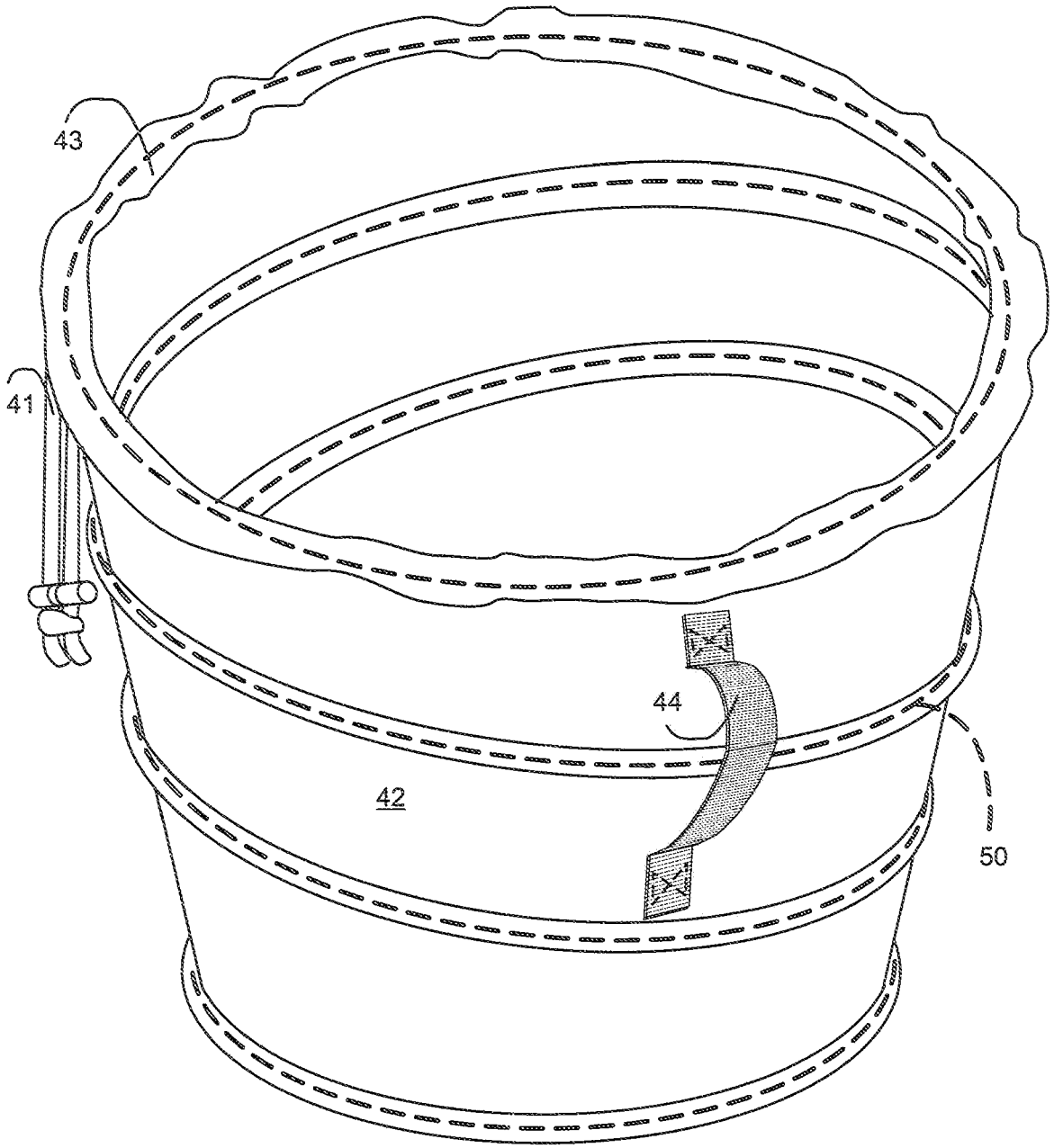
FIG. 3 is a perspective view of the inner bag of the present invention.

Turning to FIG. 3, the inner bag 40 will be described in more detail. The inner bag includes an upper edge 43 where lose material of the bag is gathered. A pull string 41 is provided that runs around the circumference of the upper edge 43. The inner bag 40 includes a sidewall 42 which includes circumferential rib 50 disposed in order to maintain the inner bag in an upright orientation. In an embodiment, the rib 50 may be formed of a metal or plastic wire which circumferentially encircles the side wall 42 of the inner bag 40. In an embodiment, the rib 50 may be sewn into the fabric of the inner bag 40. In an embodiment, the inner bag 40 may be formed of a nylon material. A handle 44 is attached to the sidewall 42 of the inner bag 40. In an alternate embodiment, the circumferential rib 50 may be provided by metals such as stainless steel or nickel plated steel, plastic, air (like blown up tube), draw string or an elastic member.

Figure 4:
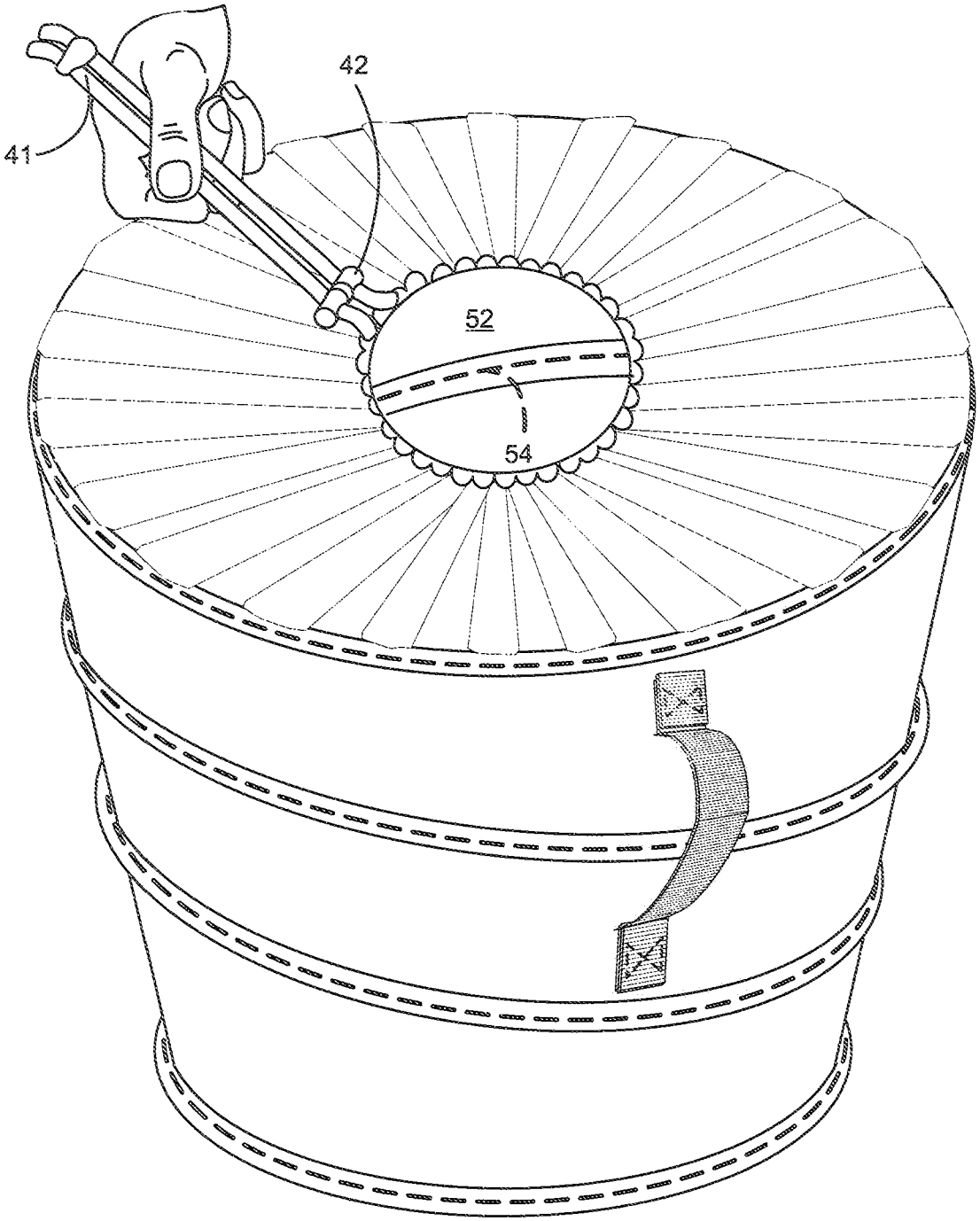
FIG. 4 is a perspective view of the inner bag of FIG. 3 showing the top cinched closed.

Turning to FIG. 4, the inner bag 40 is shown with its top in a closed position where the drawstring 41 has been pulled taught and the center crown 52 is enclosing the center of the top portion of the inner bag 40. A band 54 holds the crown 52 in a flat position. The drawstrings 41 include retainer 42 in order to grab the strings 41 and hold them in position, so that the top of the inner bag 40 remains closed. In an alternate embodiment, an elastic member may be used to pull taught the top of the inner bag 40.

In a preferred use of the receptacle 10, the waste material is inserted through the slit 18 of the lid 21 of the outer bag 20 into the inner bag 40 while the top opening of the inner bag is in an open position. When it is desired to empty the waste, the pull string 41 is pulled-tight to cinch the top of the material to the closed position as show in FIG. 4 enclosing all the waste material in the inner bag 40. The inner bag 40 is then removed from the outer bag 20 and the handle 44 may be used to carry the inner bag 40 off of a boat or other place where waste is collected for disposal.

FIG. 5 depicts a rear view of the outer bag 20 which includes a rear wall 13 that defines the body of the outer bag including the side wall 12. The rear wall 13 and side wall 12 form an opening which is enclosed by the lid 21. The lid includes slit 18 having sides 16*a,b*. At the edge where the lid is hinged 24 there are located straps 23*a,b*. The straps are formed having two sides 25*a,b*, each side being separable. A fastener is provided at the edge of each side 25*a,b*, to attach the sides together so that the strap 23*a,b* may fasten onto a mounting member such as a rail on a boat. In an embodiment, the fastener 22*a,b* may be a Velcro type member that will attach the first side 25*a* to the second side 25*b* of the strap 23*a*, so that the strap 23*a,b* may be easily opened and closed and wrapped around a rail. The lower strap 34*a,b* also includes a fastener 65*a,b* and operates as discussed above for upper straps 23*a,b*.

As depicted in FIG. 5, it can be seen that the straps 23*a,b* form generally a cylindrical area within the strap and the axis of the cylindrical area is horizontally oriented with respect to the outer bag 20. It may be understood that the straps 23*a,b* are most suitable for attaching the outer bag to a horizontal rail or chair on a boat or other vehicle. The upper straps 23*a,b*, are formed of a rugged nylon material that can resist tearing and firmly attach to the backside 13 of the outer bag 20, such as by sewing or adhesive.

The outer bag 20 also includes lower straps 34*a,b* which operate in a similar fashion as described above with respect to the upper straps and include fasteners 65*a,b*. As depicted in FIG. 5, the straps 34*a,b* have a generally cylindrical area therein having an axis that is generally vertically oriented with respect to the outer bag 20. It may be understood that the lower straps 34*a,b* are best suited to attach to a rail or other member of a boat that has a vertical orientation. With the combination of the upper straps and lower straps 34*a,b* a suitable mounting may be achieved in most any situation for a boat or a vehicle that has either a vertical or horizontal mounting member such as a rail or rigging. The backside 62 of the outer bag 20 also includes a rigid plate 67 to help support the outer bag 20 and provide for a robust back surface 62.

In an alternate embodiment, the rigid plate may be formed from PVC, plastic, cardboard, fiber glass, metals or heavy duty rubber. The base 60 of the outer bag 20 includes a buoyant member 51 such as a foam insert that may or may not be disposed in a compartment 66 formed at the base 60 of the outer bag 20. In an embodiment, a strap 70 may be provided to maintain the buoyant member 51 in a position at the base of the outer bag 20.

Figure 6:
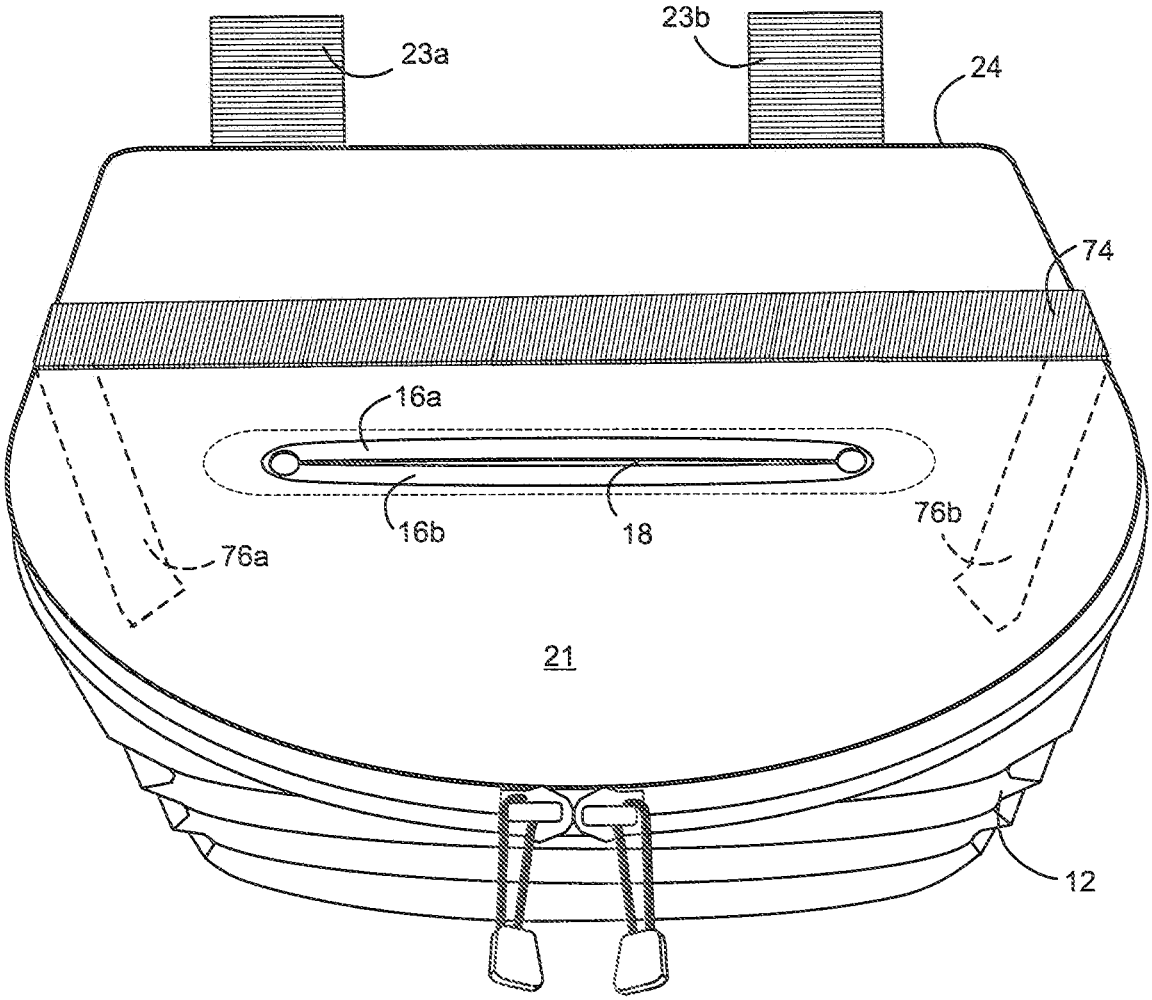
FIG. 6 is a perspective view of the waste receptacle of FIG. 1 in a collapsed condition.

Turning to FIG. 6, the bag is depicted in collapsed condition where the side wall 12 can be shown having an accordion type condition where the base 60 is oriented more closely to the lid 21. When the receptacle 10 is being transported from someone's home to a boat, or other transport it may be desirable to have the receptacle in the collapsed position so that it takes up less space. In an embodiment, an elastic strap 74 is provided to maintain the receptacle in the collapsed position. The strap 74 includes retention member 76*a,b* that help retain strap 74 on the sides 12 of the outer bag 20 and help to pull the lid 21 downward toward the base 60 to maintain the receptacle in the collapsed condition.

Figure 7:
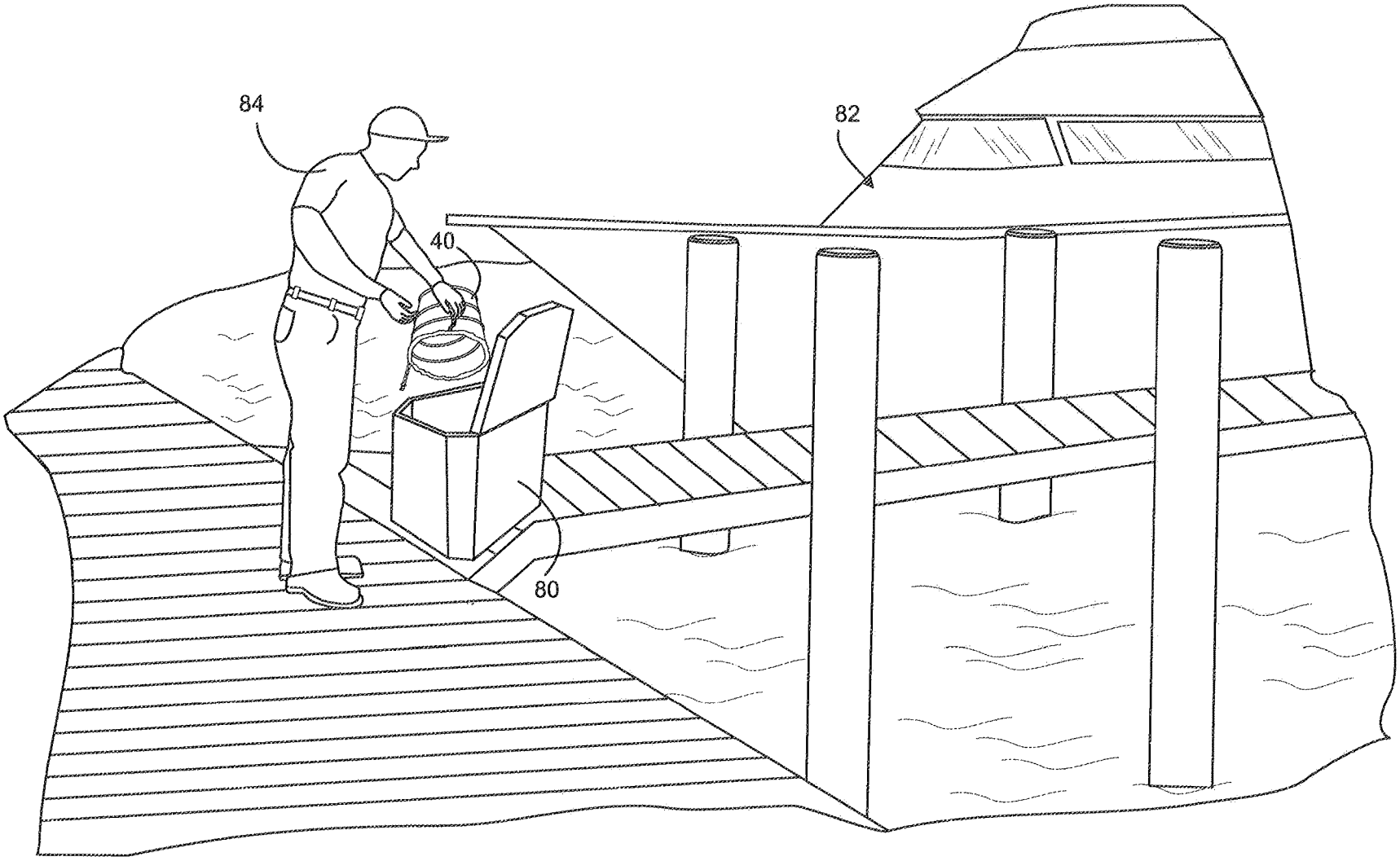
FIG. 7 is a depiction of an environment where the receptacle may be used and depicting the inner bag being emptied into a garbage bin on land.

Turning to FIG. 7, the use of the receptacle may be understood. The receptacle having been mounted on the boat 82 has been removed and the boater 84 has carried the inner bag 40 off of the boat 82 after removing it from the outer bag. The drawstring as depicted in FIG. 7 has been withdrawn so that the top of the inner bag 40 is opened and the waste material from within the inner bag 40 may be dumped into a garbage bin 80 on land, on the dock. Thus, it may be understood that the use of the receptacle 10 is easily accomplished and following the emptying of the inner bag 40 it may be quickly be returned to the boat and the outer bag 20 which may be maintained in its mounted position on the rail of the boat. The receptacle provides an environmentally friendly means of managing waste so that the waste collected from a boat trip does not end up in the water. In the situation where there are rough seas it is important that the waste does not end up in the water, but ends up in the garbage bin 80 where it can be properly removed to a at a landfill. In some circumstances an environmentally friendly receptacle and certification of the boat as an environmentally responsible vessel may be achieved by using the waste receptacle of the present invention.

What is claimed:

1. A receptacle comprising:

an outer bag having a flexible construction forming an opening at a top side and at least a pair of upper straps capable of attaching the receptacle to a rail;

a lid attached at a top of the outer bag to close the opening via a zipper extending around the top of the outer bag, the outer bag having a front side having a semi-circular shape and an opposite back side having a flat surface;

an inner bag having a backbone circumferentially disposed around the inner bag to help maintain the inner bag in a generally cylindrical shape and having a generally cylindrically shaped base, the inner bag insertable through the opening of the outer bag to mount the inner bag within the outer bag so that the base is adjacent a bottom of the outer bag having a bottom, a pull string disposed at a top of the inner bag being capable to cinch the top of the inner bag closed; and a buoyant float member disposed in the outer bag, the float member disposed in a compartment located between the bottom and the base of the inner bag, a strap to maintain the float member at the bottom.

2. The receptacle of claim 1 wherein the straps have a fastener to clamp sides of the strap together on the rail.

3. The receptacle of claim 2 wherein the fastener is a velcro type member on each side of the strap.

4. The receptacle of claim 1 wherein backbone is a plastic or metal wire that is sewn to the inner bag.

5. The receptacle of claim 1 wherein the float member is secured into bottom of the outer bag.

6. The receptacle of claim 1 wherein the lid includes a slit having flexible sides including a resilient cord disposed along each side of the slit, the slit capable of being stretched apart by at least 1 inch in order to allow for insertion of waste into the interior of the outer bag and to be received by the inner bag, the flexible sides movable between an open and closed position and the sides automatically retractable to the closed position.

7. The receptacle of claim 1 further comprising an elongated elastic band having a length of at least a width of the top of the outer bag, the band extending across the width of the top of the outer bag and retaining straps extending downward from the band to engage the sides of the outer bag in order to maintain the bag in a collapsed condition.

8. The receptacle of claim 1 further comprising a pair of lower straps located along a base of the outer bag.

9. The receptacle of claim 8 where the pair of straps include fasteners for holding the sides of the straps together and to clamp onto a post.

10. The receptacle of claim 8 wherein the pair of straps form a generally cylindrical area capable of receiving a rail or other mounting member therein and the cylindrical area having an axis disposed in a generally vertical orientation with respect to the receptacle.

11. The receptacle of claim 1 wherein the pair of upper straps form a generally cylindrical area capable of receiving a rail or other mounting member therein and the cylindrical area having an axis disposed in a generally horizontal orientation with respect to the receptacle.

12. The receptacle of claim 1 further comprising a band disposed at the bottom of the outer bag and for maintaining the buoyant member within the outer bag.

13. The receptacle of claim 1 further comprising a rigid plate disposed on a back panel of the outer bag.

14. The receptacle of claim 1 further comprising a zipper disposed along a top edge of the opening of the outer bag in order to fasten the lid in a closed condition.

15. The receptacle of claim 14 further comprising at least a pair of zipper pulls for opening and closing the zipper.

16. The receptacle of claim 1 further comprising a locating device disposed within the receptacle including one of a transmitter, light emitting device and reflector so that the receptacle may be more easily located if the receptacle is floating in water.

17. A receptacle assembly comprising: an outer bag having a lid attached at a top of the outer bag to close an opening at the top of the bag via a zipper extending around the top, the outer bag formed from a flexible material capable of orienting the outer bag between a collapsed and upright condition, the outer bag having a front side and an opposite back side, the front side forming a semi-circular shape and the back side forming a flat surface; and an inner bag formed of a flexible nylon material, the inner bag insertable through the opening of the outer bag and the inner bag having a centerline oriented along a vertical axis of the inner bag and the inner bag collapsible within the outer bag upon collapsing the outer bag in a direction parallel to the centerline; and the outer bag including a buoyant member disposed in a compartment formed at a base of the outer bag, a strap provided to maintain the buoyant member in a position at the base of the outer bag.

18. The receptacle assembly of claim 17 wherein the lid being hingedly attached to the outer bag, the lid including a slit having flexible sides including a resilient cord disposed along each side of the slit, the slit capable of being stretched apart by at least 1 inch in order to allow for insertion of waste into the interior of the outer bag and to be received by the inner bag, the flexible sides movable between an open and closed position and the sides automatically retractable to the closed position.

* * * * *